US007401822B2

(12) United States Patent
Graute

(10) Patent No.: US 7,401,822 B2
(45) Date of Patent: Jul. 22, 2008

(54) MOTOR VEHICLE DOOR LOCK

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 197 days.

(21) Appl. No.: 10/555,202

(22) PCT Filed: Apr. 30, 2004

(86) PCT No.: PCT/DE2004/000907

§ 371 (c)(1),
(2), (4) Date: Nov. 1, 2005

(87) PCT Pub. No.: WO2004/101920

PCT Pub. Date: Nov. 25, 2004

(65) Prior Publication Data

US 2006/0202486 A1 Sep. 14, 2006

(30) Foreign Application Priority Data

May 8, 2003 (DE) ..... 103 20 457

(51) Int. Cl.
*E05C 3/06* (2006.01)

(52) U.S. Cl. ..... 292/216; 292/DIG. 56

(58) Field of Classification Search ..... 292/337, 292/DIG. 56, 216
See application file for complete search history.

(56) References Cited

U.S. PATENT DOCUMENTS

| | | | | |
|---|---|---|---|---|
| 2,877,038 | A * | 3/1959 | Kramer | 292/216 |
| 5,727,825 | A * | 3/1998 | Spurr | 292/341.12 |
| 5,758,912 | A * | 6/1998 | Hamada | 292/216 |
| 6,024,389 | A * | 2/2000 | Arabia et al. | 292/216 |

FOREIGN PATENT DOCUMENTS

| | | | |
|---|---|---|---|
| FR | 2 528 095 | A1 | 12/1983 |
| FR | 2 710 097 | A1 | 3/1995 |
| GB | 2 321 928 | A | 8/1998 |

* cited by examiner

*Primary Examiner*—Gary Estremsky
(74) *Attorney, Agent, or Firm*—Matthias Scholl, PC

(57) ABSTRACT

Vehicle door latch, in which the catch comprises a casing made of sound-proofing material, the casing containing a buffer pocket, situated behind the primary position in clockwise direction and the buffer pocket being stretched around up to the area of the primary position, forming an overtravel stop cooperating with the pawl.

30 Claims, 2 Drawing Sheets

Fig. 2
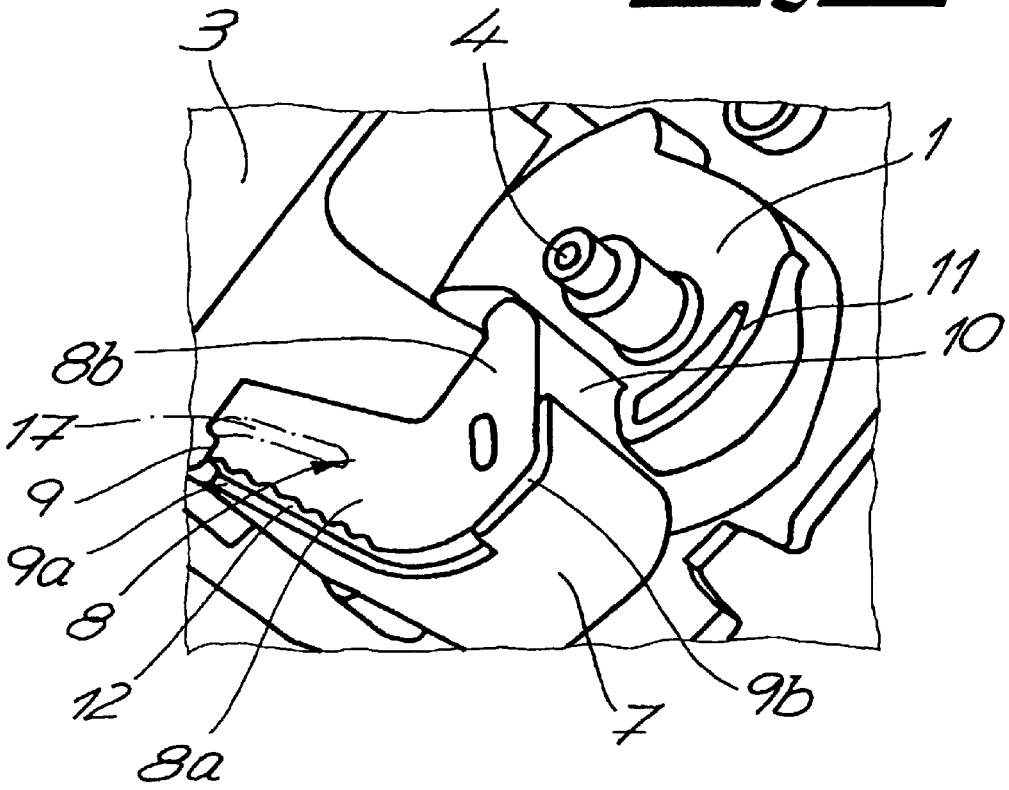
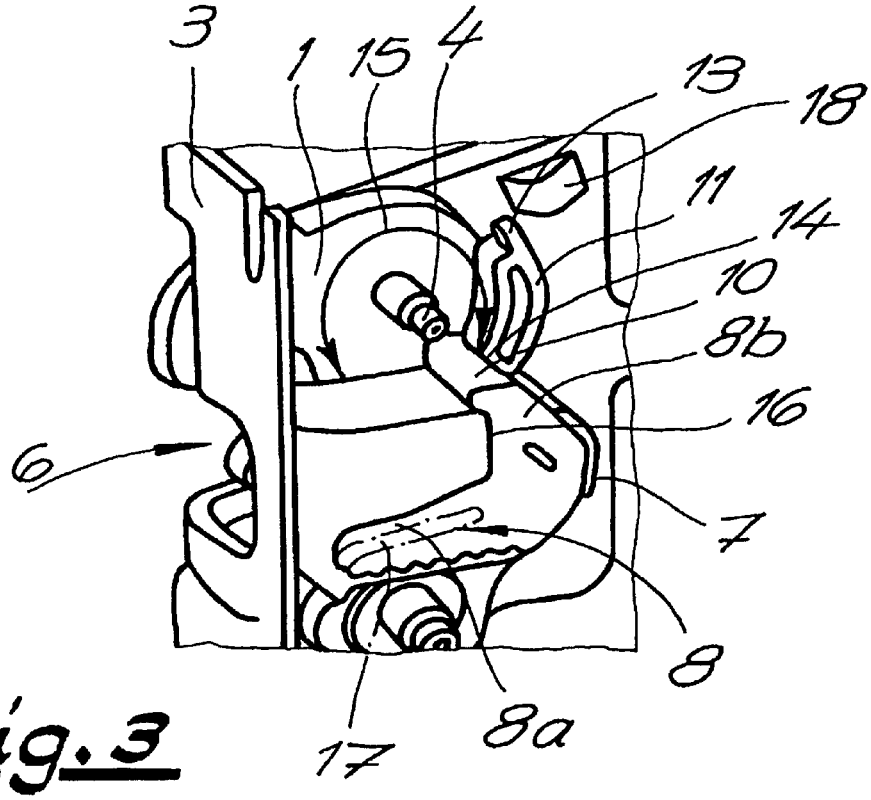
Fig. 3

MOTOR VEHICLE DOOR LOCK

CROSS-REFERENCE TO RELATED APPLICATIONS

This is a National Stage Application of International Patent Application No. PCT/DE 2004/000907, with an international filing date of Apr. 30, 2004, which is based on German Patent Application No. 103 20 457.1, filed May 8, 2003. The contents of both of these specifications are incorporated herein by reference.

BACKGROUND OF THE INVENTION

1. Field of the Invention

The invention refers to a vehicle door latch containing a locking mechanism comprising mainly a catch and pawl and a locking pin, moving into an inlet opening and interacting with the catch, with the inlet opening containing at least one soundproofing element for the locking pin.

2. Description of Related Art

A vehicle door latch of the type described above is disclosed in EP 0 336 034 A2 or WO 95/10679 A1. In the reference system of the vehicle door latch, the soundproofing element ensures that the locking pin, moving into the inlet opening and then held by the catch in its primary position, is fixed in this position with a minimum of noise. In general, a relative movement is carried out between the locking pin and the inlet opening, with the locking pin usually being fixed to the vehicle body, whilst on the other hand a vehicle door and with it the respective vehicle door latch are moved.

Apart from the described noise reduction of the soundproofing element, this component ensures that a respective vehicle door can be closed with excess stroke, so that the pawl engages correctly into the primary position of the catch. Such soundproofing elements have a proven record and are frequently used in practical applications.

We also refer to EP 1 136 640 A1, providing, however, no soundproofing element in the inlet opening for the locking pin, but instead three individual rubber buffers assigned to the catch.

A locking mechanism can, for instance, be electrically opened, by the pawl being lifted by a motor or another means, so that the catch is released and carries out a spring-driven rotation movement around its axis. In order to limit this rotation movement, separate stops can be provided inside the latch housing.

BRIEF DESCRIPTION OF THE DRAWINGS

Below, the invention is explained in detail with reference to a drawing representing only one embodiment of the invention, in which:

FIG. 1 shows the vehicle door latch of the invention without inlet insert with a top view of the locking mechanism and FIGS. 2 and 3 show different views of the inlet insert.

BRIEF SUMMARY OF THE INVENTION

Figure 1:
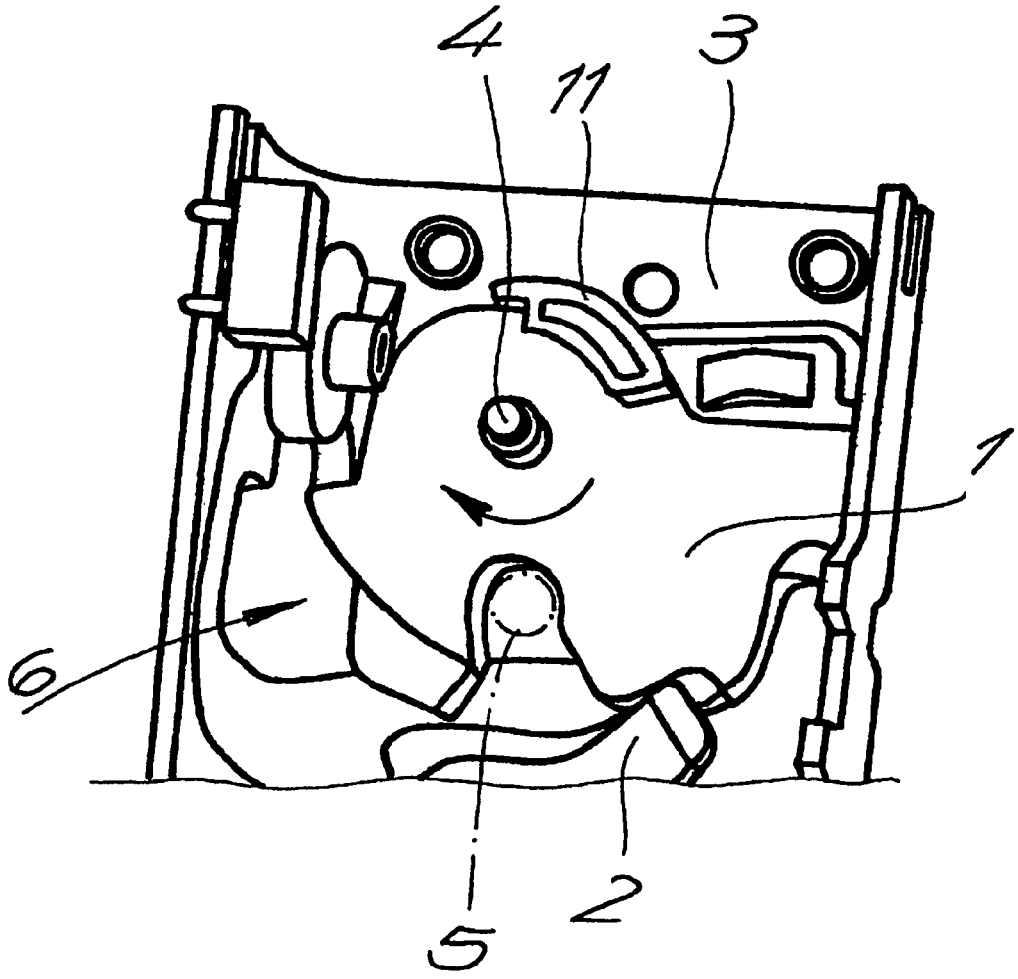

The invention described herein provides a vehicle door latch with a locking mechanism (1, 2) mainly comprising a catch (1) and pawl (2) and a locking pin (5), moving into an inlet opening (6) and interacting with catch (1), with the inlet opening (6) containing at least one soundproofing element (8) for the locking pin (5), characterized in that the soundproofing element (8) also acts as a cushion for the catch (1).

In certain embodiments of the invention described herein, the soundproofing element (8) restricts the opening movements of the catch (1).

In certain embodiments of the invention described herein, the soundproofing element (8) is designed as an L-shaped insert for a receiving groove (9).

In certain embodiments of the invention described herein, the long L-leg (8*a*) of the soundproofing element (8) is designed as a holding leg (8*a*) and the short L-leg (8*b*) of the soundproofing element (8) as a cushioning leg (8*b*) for the locking pin (5) and the catch (1).

In certain embodiments of the invention described herein, the holding leg (8*a*) contains recesses (12) allowing easy crosswise insertion into the receiving groove (9).

In certain embodiments of the invention described herein, the cushioning leg (8*b*) contains a locking pin stop face (16) on the inside and a catch stop face (10) on the outside.

In certain embodiments of the invention described herein, the inlet opening (6) and the receiving groove (9) are arranged mainly parallel to and amongst each other.

In certain embodiments of the invention described herein, the inlet opening (6) and the receiving groove (9) together form an inlet insert (7) for a latch housing (3).

In certain embodiments of the invention described herein, the cushioning leg (8*b*) protrudes at least partially from the inlet insert (7).

In certain embodiments of the invention described herein, the soundproofing element contains a temporarily closed cover for inserting, for instance, an emergency locking tool.

DETAILED DESCRIPTION OF THE INVENTION

The invention is based on the technical problem of further developing a vehicle door latch of the above type, in such a way that the design is simplified and, in particular, the number of the required components is reduced.

To solve this technical problem, a vehicle door latch of this type is characterized by the soundproofing element also operating as a cushion for the catch. In other words, the soundproofing element has two functions. On one hand, as a noise-reducing stop for the locking pin and, on the other hand, as the cushion for the catch. In order to restrict the rotation movement of the catch, a stop or limit stop can be provided in the back plate or latch housing. In general, the soundproofing element or the cushion for the catch can also carry out the function of a stop and restrict the opening movements of the catch. This means that the rotation movements of the catch after lifting of the pawl, as described above and regularly associated with an electrical and mechanical opening of the locking mechanism, are restricted by a separate stop or limit stop or by the soundproofing element.

In any case, the catch is not only fixed during an opening movement and is, so to speak positioned in an opened state, but at the same time, the cushion ensures that the catch does not move directly against a hard stop during the described opening process but that instead, its movement is cushioned. At the same time, the soundproofing element ensures that the catch positioned in its open position is acoustically uncoupled from an obligatory latch housing, so that no rattling noise can be heard. This also prevents that the electric opening or opening movements of the catch initiated in any other manner generate a noise when moving against a stop. The soundproofing element does actually prevent such stop-related noises.

In a proven embodiment, the soundproofing element is designed as a L-shaped insert for the inlet opening. One L-leg of the L-shaped soundproofing element may be designed as a holding leg and the other L-leg as a cushioning leg for the locking pin and the catch. The cushioning leg provides not only a stop for the locking pin but also a stop for the catch.

For this purpose, the inside of the cushioning leg contains a locking pin stop face and the outside a catch stop face. The locking pin stop face is located at the end of the inlet opening, whilst the catch stop face protrudes over the inlet opening on the outside.

In order to be able to easily position the soundproofing element opposite the inlet opening, the holding leg contains recesses, guarantying a tilt-free and easy crosswise insertion into a receiving groove. The receiving groove is arranged mainly parallel to the inlet opening. It is, in most cases, located below the inlet opening and forms together with the inlet opening an inlet insert for a latch housing.

This means that this inlet insert, which may be a molded plastic part, can be inserted into the latch housing, not only accommodating the locking mechanism but also the usual lever apparatus, latched to it or connected in another manner. Prior to this, the soundproofing element was inserted into the receiving groove of the inlet insert, with the recesses on the holding leg ensuring the described easy crosswise insertion.

The cushioning leg, on the other hand, protrudes at least partially from the inlet insert for the catch to move against with a stop, projection, etc. and receives, at the same time, the required cushioning. The invention also suggests that the soundproofing element contains a, in most cases, fitted and temporarily-closed cover for the insertion of, for instance, an emergency locking tool. The emergency locking tool (in the simplest form an ignition key) is able to move a locking lever or generally the locking lever mechanism into the "locked" position if, for instance, the central locking has failed.

As a result, a vehicle door latch is provided that contains a prefabricated inlet insert for the latch housing, whose soundproofing element carries out at least two functions. On one hand, the soundproofing element ensures that the locking pin meets a limit stop and that, in particular, in the primary position, the catch is not only safely positioned but also, at the same time, fixed without nearly any noise. This is because the soundproofing element is generally made of a thermoplastic plastic, in particular, polyurethane (PUR) or rubber. Shore-A hardnesses of 60 to 90 and preferably of 70, have been proven to be advantageous.

On the other hand, the soundproofing element with its cushioning leg protruding over the inlet insert provides the additional function of acting as a cushioning stop for the catch. For this purpose, the catch contains a rib, a projection, a journal or a similar stop, which lies against the cushioning leg upon completion of its opening movement. This causes the catch to correctly assume its open position with, at the same time, the opening movement being stopped and maintained practically without any noise, so that the vehicle door latch according to the invention produces hardly any externally audible noise or transmits structure-borne noise via the vehicle body. These are the main advantages of the invention.

The figures contain a vehicle door latch, showing mainly a locking mechanism 1, 2 comprising catch 1 and pawl 2, which are arranged together in a latch housing or back plate 3. As soon as the pawl 2 is lifted out, the catch 1, as shown in FIG. 1 turns clockwise, as indicated by the arrow, around its axis 4 out of the indicated primary position by means of a spring. At the same time, a locking pin 5—only indicated—is released so that the respective vehicle door—not shown—can be opened in the usual manner. The lifting out of the pawl 2 can be achieved by purely mechanical means via an actuating lever mechanism—not shown—or by means of a motor, in particular an electric motor, as detailed under electric opening, described above.

In order to return the catch 1 to its first or primary position, the locking pin 5 in the reference system of the vehicle door latch, moves into an inlet opening 6, shown in particular in FIGS. 2 and 3. This inlet opening 6 is defined by an inlet insert 7, which preferably can be designed as a molded plastic part. The inlet insert 7 is inserted in the latch housing or the back plate 3 and can, for instance, be connected to it by latching or another means. Apart from the inlet opening 6, the inlet insert 7 contains a receiving groove 9 for a soundproofing element 8.

The soundproofing element 8 can, for instance, be made from thermoplastic plastic, according to the PUR (polyurethane) embodiment. It has an L-shaped form with a long L-leg 8*a* and a short L-leg 8*b*. The long L-leg 8*a* is designed as a holding leg 8*a* and generally serves to support the locking pin 5 compared to the catch 1. To assist this process, a spring lip 17 may be molded to the holding leg 8*a*, extending from the holding leg 8*a* inwards within the inlet insert 7. In principle, the locking pin 5 can, however, also lie directly against the short L-leg 8*b*. The object of the invention naturally also covers a combined version. In one way or another, the long L-leg 8*a*, the short L-leg 8*b* and, where applicable, the spring lip 17 ensure that the locking pin 5 is correctly held and guided into the inlet opening 6 with a minimum of noise.

The inlet opening 6 in the inlet insert 7 has a funnel or conical shape and is restricted at its end side by the short L-leg or the cushioning leg 8*b*. Logically, the locking pin 5 lies against the cushioning leg 8*b* in the primary position of catch 1 shown in FIG. 1, said cushioning leg also restricting the movement of the locking pin 5 and providing, at the same time, a low-noise fixing in the primary position of the catch 1.

The receiving groove 9 in the inlet insert 7 is also L-shaped, with its short L-leg 9*b* being open towards the top, whilst the long L-leg 9*a* of receiving groove 9 accommodates the long L-leg 8*a* or holding leg 8*a* of the soundproofing element 8. Because of the open shape of the L-legs 9*b* of the receiving groove 9, the short L-leg 8*b* or the cushioning leg of the soundproofing element 8 is able to protrude at least partially from the inlet insert 7, as clearly recognizable in FIGS. 2 and 3.

This end of the cushioning legs 8*b* of the soundproofing element 8 protruding from the inlet insert 7, defines a catch stop face 10. As after completion of its opening movement, the catch 1 lies, preferably with a projection 11—a molded rib 11 according to the embodiment—against the respective catch stop face 10. In principle, the catch stop face 10 can alternatively or additionally contain a stop or limit stop 18 for the catch 1, arranged in the latch housing or back plate 3. This limit stop 18 restricts an overtravel movement of the catch 1.

In order to be able to correctly position the long L-leg 8*a* or holding leg 8*a* of the soundproofing element 8 within the receiving groove 9, the holding leg 8*a* contains recesses 12, allowing easy crosswise insertion of the holding leg 8*a*. Catch 1 may also contain a plastic casing, for minimizing any noise when reaching the opening position of the catch 1 shown in FIGS. 2 and 3 and also in the primary position according to FIG. 1. At the same time, the plastic casing ensures that the locking pin 5 interacts with catch 1 with a minimum of friction and noise.

Also, a spring stop 13 on catch 1 is shown, upon which a leg spring—not expressly shown—acts, in order to initiate the described opening movement of the catch 1 in clockwise direction, as shown in FIG. 1 and to initiate such movement with the pawl 2 lifted.

The projection 11 or the rib or stop rib 11 on the catch 1 has a circular arc profile and contains a rib stop face 14, whose gradient corresponds to the inclination of the catch stop face 10 or of the cushioning leg 8*b* of the soundproofing element 8 when the catch 1 is in open position. Because the stop or the rib 11 protrudes from the catch 1, the inlet insert 7 can be positioned in the immediate vicinity of the catch 1, as the stop or the rib 111 on the whole finds a recess 15 at this point, represented by a circular arc in FIG. 3 and permitting the required movements of the catch 1. At the end side of the inlet opening 6, a locking pin stop face 16 is shown on the inside of the inlet opening 6 on the cushioning leg 8*b*.

What is claimed is:

1. A vehicle door latch with a locking mechanism (1, 2) comprising a latch housing (3), having an inlet opening (6) for receiving a locking pin (5);

a catch (1);

a pawl (2); and at least one soundproofing element (8);

wherein at least one said soundproofing element is disposed in said inlet opening (6);

at least one said soundproofing element (8) also acts as a cushion for said catch (1);

at least one said soundproofing element (8) restricts opening movement of said catch (1);

said latch housing (3) comprises a receiving groove (9); and said soundproofing element (8) is an L-shaped insert for said receiving groove (9).

2. The vehicle door latch of claim 1, wherein said inlet opening (6) and said receiving groove (9) are disposed substantially parallel to each other.

3. The vehicle door latch of claim 1, wherein said inlet opening (6) and said receiving groove (9) taken together form an inlet insert (7) of said latch housing (3).

4. The vehicle door latch of claim 3, wherein said short L-leg (8*b*) protrudes at least partially from said inlet insert (7).

5. A vehicle door latch with a locking mechanism (1, 2) comprising a latch housing (3), having an inlet opening (6) for receiving a locking pin (5);

a catch (1);

a pawl (2); and at least one soundproofing element (8);

wherein at least one said soundproofing element is disposed in said inlet opening (6);

at least one said soundproofing element (8) also acts as a cushion for said catch (1);

at least one said soundproofing element (8) restricts opening movement of said catch (1);

said soundproofing element (8) comprises a long L-leg (8*a*) and a short L-leg (8*b*); said long L-leg (8*a*) being a support for said locking pin (5) with respect to said catch (1); and said short L-leg (8*b*) being a stop for said locking pin (5) and a stop for said catch (1).

6. The vehicle door latch of claim 5, wherein said long L-leg (8*a*) comprises a plurality of recesses (12) allowing for an easy crosswise insertion of said soundproofing element (8) into said receiving groove (9).

7. The vehicle door latch of claim 5, wherein said short L-leg (8*b*) comprises a locking pin stop face (16) and a catch stop face (10).

8. A vehicle door latch comprising a latch housing (3) having an inlet opening (6);

a catch (1);

a pawl (2);

a locking pin (5) being engaged with said catch (1) within said inlet opening (6); and at least one soundproofing element (8) being disposed within said inlet opening (6) and also acting as a cushion for said catch (1) when said catch is in an overtravel position;

wherein said soundproofing element (8) comprises a long L-leg (8*a*) and a short L-leg (8*b*).

9. The vehicle door latch of claim 8, wherein said soundproofing element (8) reduces the noise created by a movement of said locking pin (5) within the vehicle door latch.

10. The vehicle door latch of claim 9, wherein said soundproofing element (8) restricts the movement of said catch (1) within the vehicle door latch.

11. The vehicle door latch of claim 8, wherein said soundproofing element (8) reduces the noise created by a movement of said catch (1) within the vehicle door latch.

12. The vehicle door latch of claim 8, wherein said soundproofing element (8) reduces the vibrations created by a movement of said catch (1) within the vehicle door latch.

13. The vehicle door latch of claim 8, wherein said soundproofing element (8) restricts the movement of said catch (1) within the vehicle door latch.

14. The vehicle door latch of claim 8, wherein said long L-leg (8*a*) is a support for said locking pin (5) with respect to said catch (1); and said short L-leg (8*b*) is a stop for said locking pin (5) and a stop for said catch (1).

15. The vehicle door latch of claim 14, wherein said short L-leg (8*b*) comprises a locking pin stop face (16) and a catch stop face (10).

16. The vehicle door latch of claim 15, wherein said locking pin stop face (16) is located at the end of said inlet opening (6).

17. The vehicle door latch of claim 15, wherein said catch stop face (10) protrudes over said inlet opening (6).

18. The vehicle door latch of claim 8, wherein said latch housing (3) comprises a receiving groove (9).

19. The vehicle door latch of claim 18, wherein said long L-leg (8*a*) comprises a plurality of recesses (12) allowing for an easy crosswise insertion of said soundproofing element (8) into said receiving groove (9).

20. The vehicle door latch of claim 18, wherein said inlet opening (6) and said receiving groove (9) are disposed substantially parallel to each other.

21. The vehicle door latch of claim 18, wherein said inlet opening (6) and said receiving groove (9) taken together form an inlet insert (7) of said latch housing (3).

22. The vehicle door latch of claim 21, wherein said inlet insert (7) is made of molded plastic.

23. The vehicle door latch of claim 21, wherein said short L-leg (8*b*) protrudes at least partially from said inlet insert (7).

24. The vehicle door latch of claim 8, wherein said soundproofing element (8) ensures that said locking pin (5) meets a limit stop.

25. The vehicle door latch of claim 8, wherein said soundproofing element (8) ensures that said catch (1) is safely positioned and fixed without nearly any noise.

26. The vehicle door latch of claim 8, wherein said soundproofing element (8) is made of a thermoplastic.

27. A vehicle door latch with a locking mechanism (1, 2) comprising a latch housing (3), having an inlet opening (6) for receiving a locking pin (5);

a catch (1);

a pawl (2); and a soundproofing element (8);

wherein said soundproofing element is disposed in said inlet opening (6);

said soundproofing element (8) acts as a cushion for said catch (1);

said soundproofing element (8) comprises a long L-leg (8*a*) and a short L-leg (8*b*), said long L-leg (8*a*) is a support for said locking pin (5) with respect to said catch (1); and said short L-leg (8*b*) is a stop for said locking pin (5) and a stop for said catch (1).

28. The vehicle door latch of claim 27, wherein said long L-leg (8*a*) comprises a plurality of recesses (12) allowing for an easy crosswise insertion of said soundproofing element (8) into said receiving groove (9).

29. The vehicle door latch of claim 27, wherein said short L-leg (8*b*) comprises a locking pin stop face (16) and a catch stop face (10).

30. The vehicle door latch of claim 29, wherein said catch stop face (10) protrudes over said inlet opening (6).

* * * * *